United States Patent [19]

Ueda et al.

[11] Patent Number: 5,046,013

[45] Date of Patent: Sep. 3, 1991

[54] QUALITY CONTROL SYSTEM IN A SPINNING MILL

[75] Inventors: Yutaka Ueda, Nara; Yoshihiko Samoto, Kusatsu, both of Japan

[73] Assignee: Murata Kikai Kabushiki Kaisha, Kyoto, Japan

[21] Appl. No.: 314,502

[22] Filed: Feb. 23, 1989

[30] Foreign Application Priority Data

Mar. 1, 1988 [JP] Japan ..... 63-49116

[51] Int. Cl.[5] ..... G06F 15/46

[52] U.S. Cl. ..... 364/470; 57/264

[58] Field of Search ..... 364/470, 188, 468; 340/525; 57/265, 264, 81; 139/370.2, 62, 35

[56] References Cited

U.S. PATENT DOCUMENTS 3,844,139 10/1974 De Cerjat et al. ..... 66/50 R 4,294,065 10/1981 Lane ..... 57/265

4,396,040 8/1983 Brouwer ..... 139/370.2

4,656,465 4/1987 Erni et al. ..... 57/81

4,835,699 5/1989 Mallard ..... 364/470

*Primary Examiner*—Jerry Smith

*Assistant Examiner*—Paul Gordon

*Attorney, Agent, or Firm*—Spensley, Horn, Jubas & Lubitz

[57] ABSTRACT

A quality control system in a spinning mill, wherein communication networks for yarn processing steps of information regarding the status of products are provided and malfunction detection apparatus for detecting a malfunction of the steps is provided on at least one of the processing steps so that the cause of occurrence of a malfunction may be grasped to pursue the cause tracing back to the previous processing steps through the networks.

8 Claims, 7 Drawing Sheets

QUALITY CONTROL SYSTEM IN A SPINNING MILL

FIELD OF THE INVENTION

The present invention relates to a quality control system in a spinning mill.

RELATED ART STATEMENT

In the spinning mill, woven stuff or knitwork are produced via various yarn processing steps from the step for receiving material to the weaving and knitting steps. For example, in case of cotton woven stuff, they are produced via multiple stages of processing steps including (a) mixing and blowing step for opening, dust-removing and mixing cotton as material, (b) combing step for combing fibers to make them parallel, (c) drawing step for doubling and proportioning, (d) roving step for making sliver fine, (e) fine spinning step for forming yarns, (f) unwinding step for unwinding the spinned yarns, (g) doubling and twisting step as the case may be, (h) warping step for forming a warp beam, (i) weaving step for weaving warp and weft yarns and so forth.

The processing steps as described above are normally carried out independently, and various quality inspections from the inspection for receiving raw cotton to the inspection for finished products. However, most of these inspections are the out-of-line inspection for inspecting a sample or the check at the final stage in each of the processing steps, and the like. These inspections are a mere after-processing after products have been produced, and defective products are merely discarded.

OBJECT AND SUMMARY OF THE INVENTION

An object of the present invention is to provide a quality control system in which a real time check of quality inspection and a pursuit for the cause of defective products can be performed not only within the processing steps but also by tracing back to the previous steps.

In an embodiment of the present invention, communication networks for yarn processing steps or information regarding the status of products are provided and malfunction detection means for detecting a malfunction of the steps is provided on at least one of the processing steps so that the cause of occurrence of a malfunction may be grasped to pursue the cause tracing back to the previous processing steps through the networks.

DETAILED DESCRIPTION OF PREFERRED EMBODIMENTS

The embodiment of the present invention will be described hereinafter with reference to the drawings.

Figure 1:
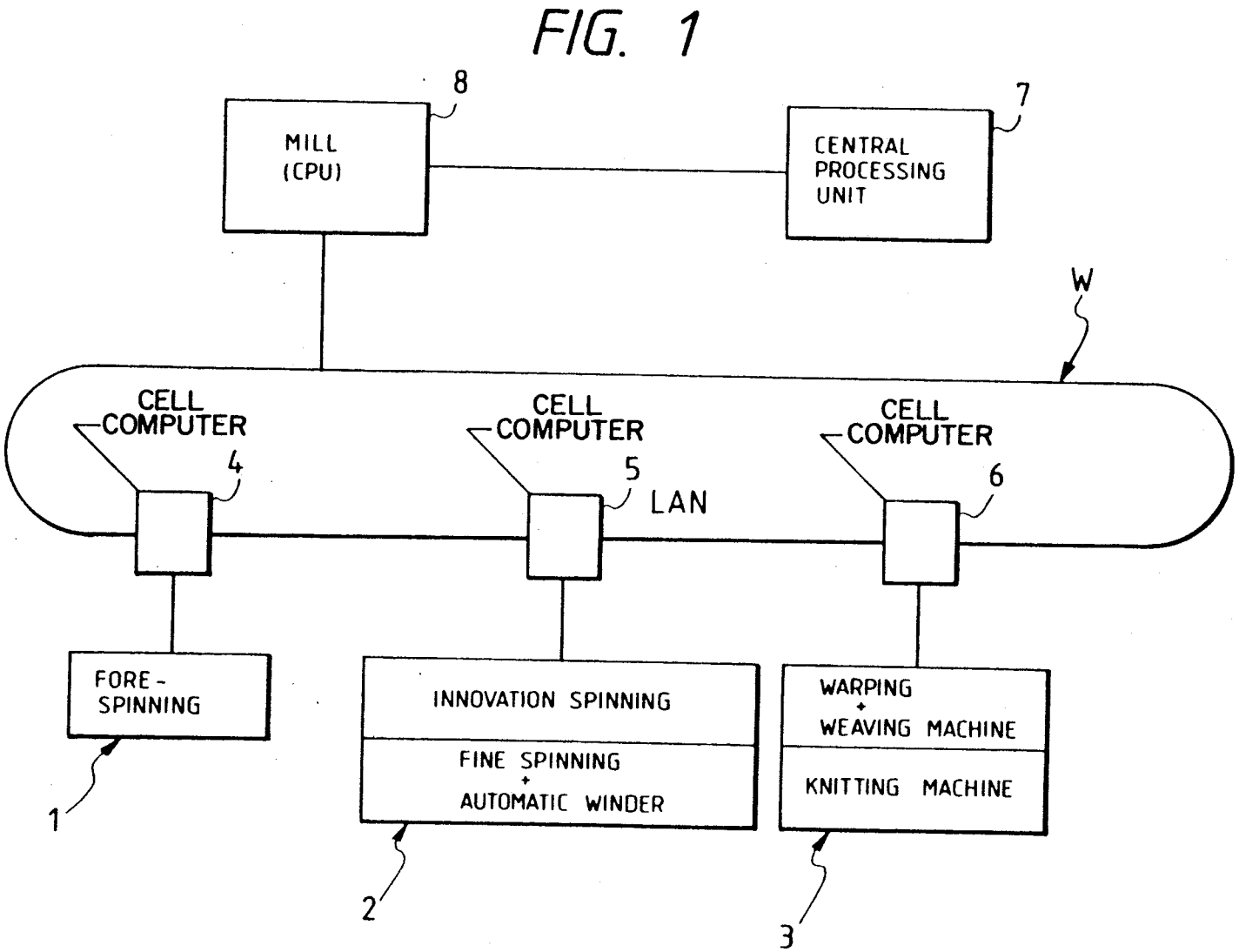
FIG. 1 is a schematic block diagram of the system according to an embodiment of the present invention.

FIG. 1 shows a structural view of the system according to an embodiment of the present invention.

In the present embodiment, the aforesaid processing steps are roughly grouped into three sections, that is, fore-spinning step (1) from the mixing and blowing step to the roving step, spinning step (2) for producing yarns by the open-end spinning, pneumatic spinning and fine spinning winder in which a ring fine spinning machine and a winder are connected, and weaving and knitting step (3) for producing woven stuff or knitwork by use of the produced yarns.

A computer for controlling the above-described steps is called a cell computer. In case of FIG. 1, cell computers 4, 5 and 6 for the respective steps are equally connected by a communication network W called LAN, the communication network W being connected to a central processing unit 7 in a main office through a mill computer 8.

That is, the central processing unit 7 in the entire company system issues, on the basis of the orders from customers or production planning, a production command to each mill, and the production mill performs, on the basis of the production command, the designing of products, step planning for the respective steps, the inventory control of raw materials, the control of operation of equipment, the quality control and the like. These controls are carried out by the mill computer 8, and the control of machineries and equipment and collection of information are carried out by the communication network W. On the basis of the aforesaid production command, the cell computers 4, 5 and 6 perform the control of operation of the machineries in the respective steps and the transfer of information to and from the cell computers in the other steps so that the operating state may be controlled most efficiently. That is, the cell computers perform the communication for the purpose of maintaining the normal operation or controlling the production speed of the previous or after steps when a trouble occurs in any of steps to lower the production speed.

Figure 2:
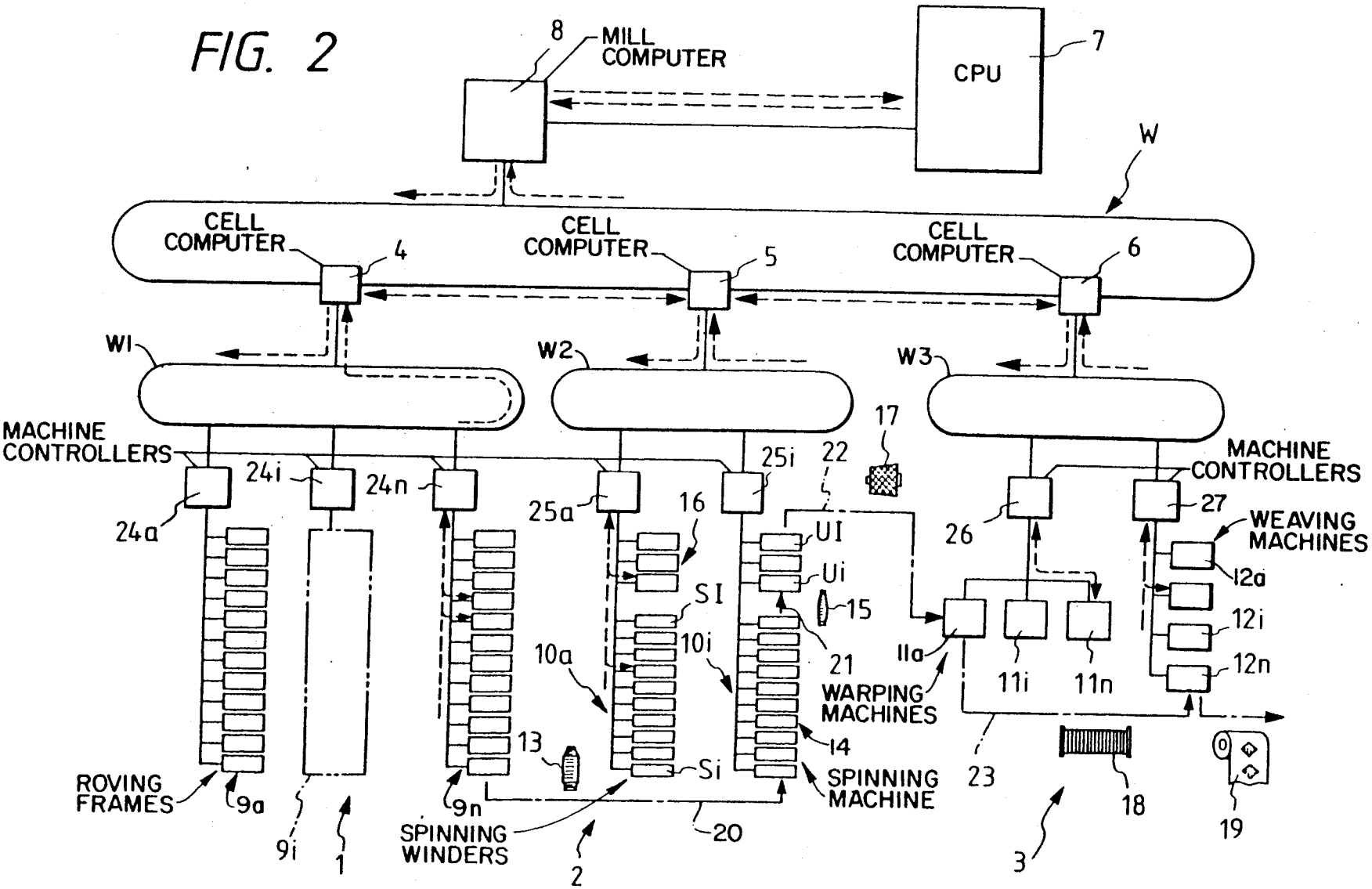
FIG. 2 is a lay-out showing an embodiment of the system.

Next, a specific example of the above-described system is shown in FIG. 2. In FIG. 2, communication networks W1, W2 and W3 between the machine beds are further connected to the cell computers 4, 5 and 6, respectively, in FIG. 1. In FIG. 2, for example, the fore-spinning step (1) is composed of roving frames or machines 9*a*, 9*i* and 9*n*; the yarn production step (2) composed of fine spinning winders 10*a* and 10*i* in which a ring fine spinning machine is linked to a winder; and the weaving and knitting step (3) composed of warping machines 11*a* to 11*n* and weaving machines 12*a* to 12*n*. That is, a roving bobbin 13 produced by the roving machine 9*n* is supplied to a fine spinning machine 14, and the sliver is finely drafted and wound in the form of a fine spinning bobbin 15 as a spinning yarn. The fine spinning bobbin 15 is further supplied to an automatic winder 16 and is unwound into a package 17 having the shape and quantity of yarns as desired while removing defects of yarns. The package 17 produced by the automatic winder is transferred to the weaving step 3 and supplied to the warping machine 11*a* where yarns drawn out of a number of packages are wound on a single warp beam to produce a beam 18 for warp yarns of the weaving machine. The warp beam 18 is further set to the weaving machine 12*n* to produce a woven stuff 19.

On the other hand, for the setting of operating conditions of the machine beds and for the control of machineries and apparatuses, control signals are transmitted toward the terminals of each of the machine beds from the central processing unit 7 or the host computer 8 in the mill through the communication networks in FIG. 2, and various data of the operating conditions and information of yarn quality and the like are transmitted toward the central processing unit 7 from the terminals of each of the machine beds so that they are monitored.

In FIG. 2, reference numerals 24*a*, 24*i* and 24*n* designate machine controllers for directly controlling or monitoring the machine beds of the roving machines; 25*a* and 25*i*, machine controllers for controlling the machine bed of the fine spinning winder; 26, a machine controller for controlling the warping machines 11*a* to 11*n*; and 27, a machine controller for controlling the weaving machines.

Next, the yarn quality control system in the above-described embodiment will be explained. In the yarn processing directions as indicated by arrows 20, 21, 22 and 23, in at least one processing step, malfunction detection means is installed to collect and analyze detection signals of the malfunction detection means and provide a malfunction only within the said processing step or provide certain information to the previous step from the communication network whereby quality information of yarns between the processing steps or data are communicated to persue the the cause of occurrence of malfunction.

Figure 3:
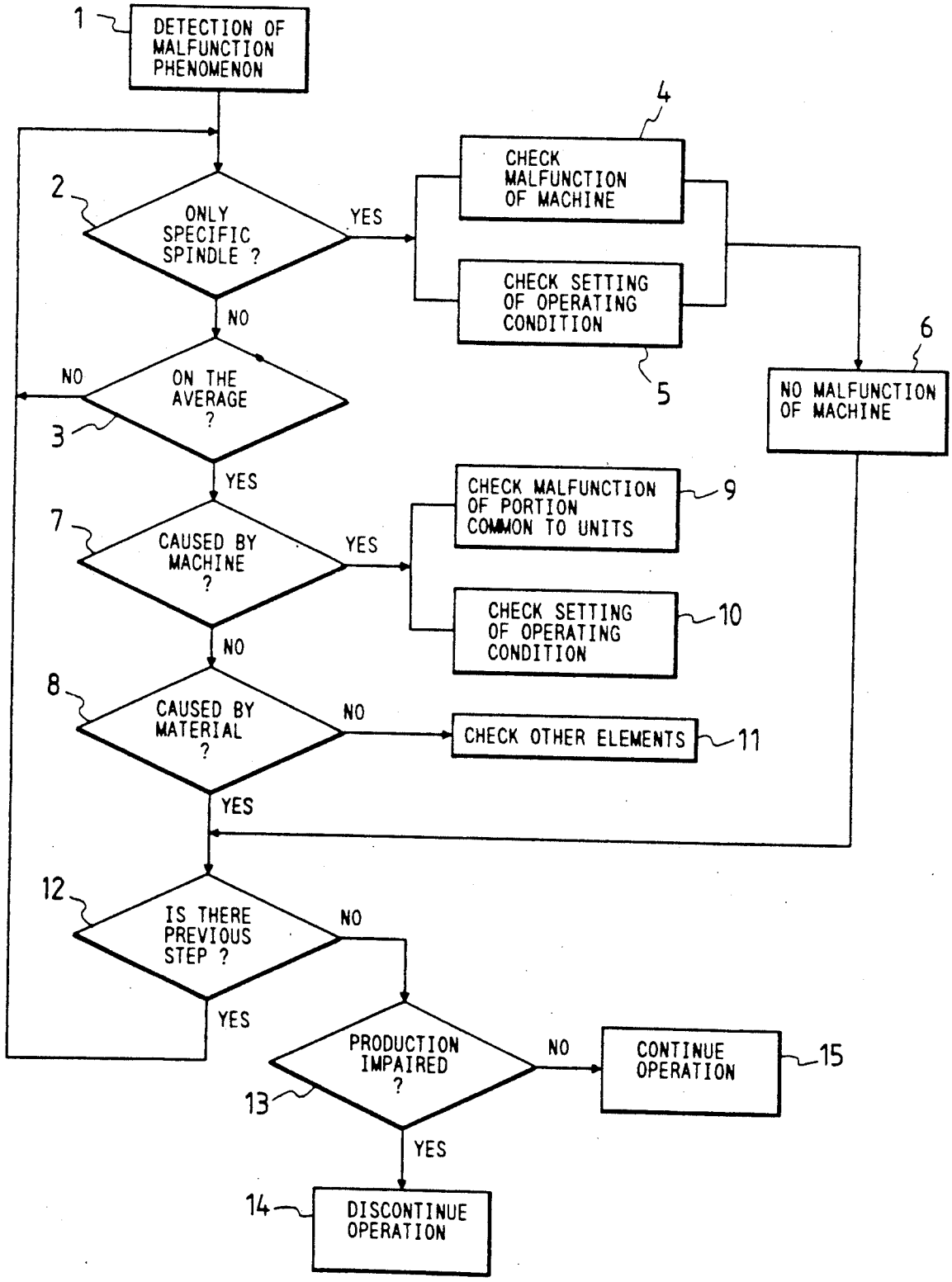
FIG. 3 is a flow chart of the pursuit of cause of defect.

FIG. 3 shows a flow chart for the control of pursuing the cause of defective yarns. For example, in a certain processing step, it is assumed that a controller provided on the machine bed composed of a number of processing units (for example, winding units at minimum unit in the winder) has detected some malfunction phenomenon, that is, a malfunction phenomenon such that the yarn-cut abnormally much or less occurs which most likely occurs during the yarn processing (Step ①). Is the malfunction phenomenon occurred merely in a specific spindle? (Step ②). Or the phenomenon occurs on the average over a plurality of spindles, which is to be discriminated (Step ③). Where the malfunction phenomenon occurs merely in the specific spindle, check the malfunction of the machine for said spindle (Step ④). Check if the operating condition of the spindle is erroneously set (Step ⑤). When judgement is made that the machine involves no malfunction (Step ⑥), discrimination is made of the presence or absence of the previous step where the yarn supplied to said spindle was produced (Step ). If the previous step is present, the step is traced to the previous step and a check command signal is transmitted between the cell computers (4 and 5 in FIG. 1).

In the case where in the Step ③, judgement is made that the malfunction occurs on the average over the plurality spindles, discrimination is made if the cause of occurrence results from the machine (Step ⑦) or results from the yarn itself, that is, from material (Step ⑧). In the case of the cause resulting from the machine, check the malfunction of a portion common to a plurality of spindle units. Also, check if the operating condition is erroneously set (Step ).

In the case where the cause results from neither machine nor material, other elements are persued for investigation (Step ).

On the other hand, in the case where the cause of occurrence of malfunction results from material, discrimination is made if the other processing step is present before the subject processing step (Step ). In the case where the previous step is present, the network is utilized to pursue and investigate the abnormal spindle in the previous processing step. In the case where the previous step is not present, judgement is made that there is a problem in material supplied to the subject processing step, in which case, however, if production continues, the after-step encounters a trouble, and whether or not an impediment of production occurs is descriminated by exchange of information with the mill control computer or the central processing unit by the networks (Step ). In the case where the impediment of production occurs, the operation of the subject step is stopped (Step ). In the case where even if the operation continues, no impediment of production occurs, the operation continues (Step ).

In this manner, steps are successively traced back to pursue the cause of defects.

Figure 4:
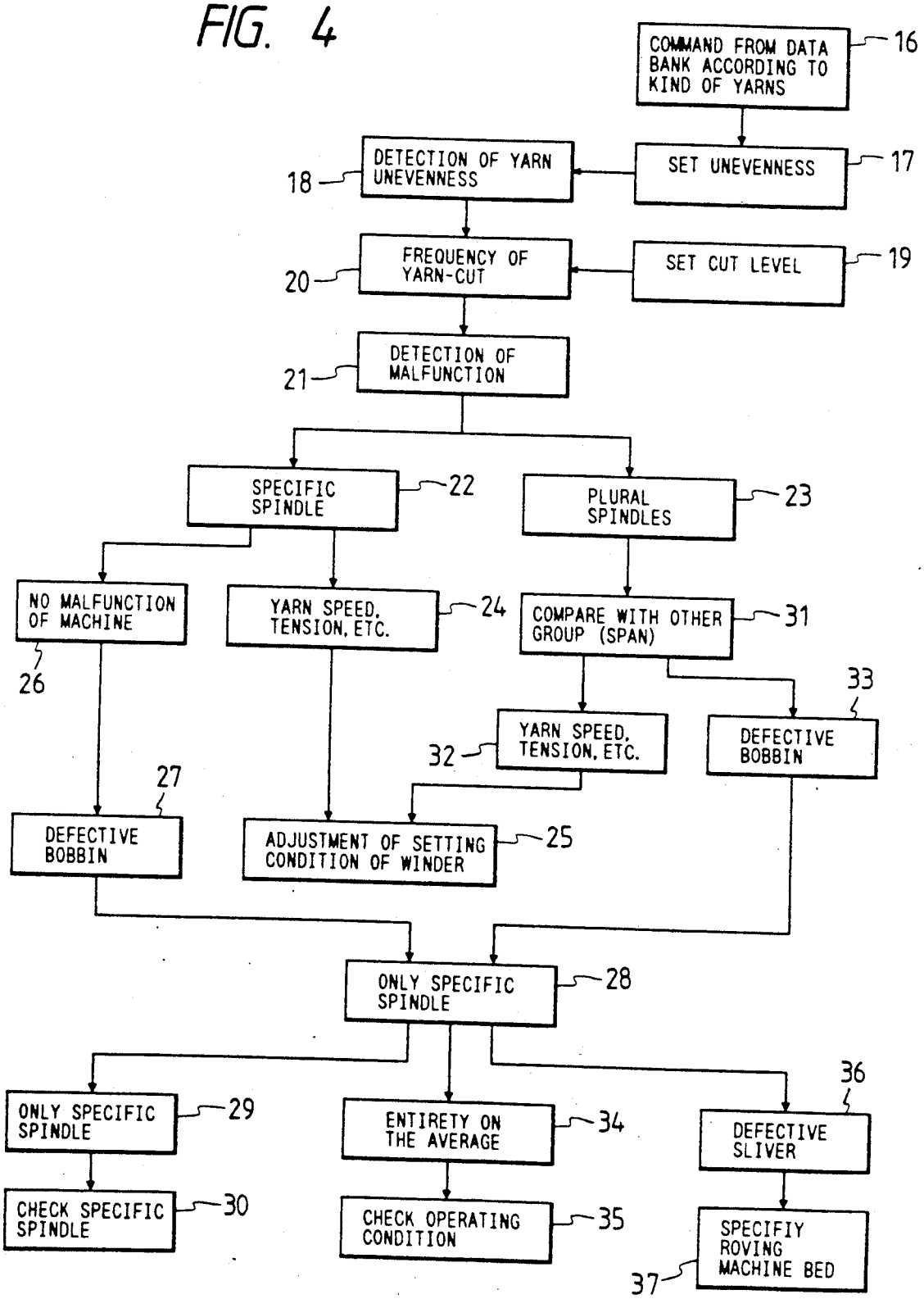
FIG. 4 is a flow chart in the case where malfunction detection means is provided on an automatic winder.

FIG. 4 shows a specific example of the above-described flow chart (FIG. 3), which is a mere single flow chart capable of pursuing the cause of the aforesaid defect particularly when malfunction detection means is installed on the automatic winder.

One example of an automatic winder applied to the above-described system will be described with reference to FIGS. 5 and 6. FIG. 6 shows an example of a winding unit (spindle) which is a minimum unit constituting an automatic winder. A yarn 30 released and drawn from a fine spinning bobbin 15 passes through a balloon breaker 31 and a tension device 32, and a yarn defect is checked by a yarn defect detection head 34 of a yarn clearer 33 which is malfunction detection means for the yarn, and at the same time the yarn is wound on a package 17 rotated by a traverse drum 35.

During the winding, a variation of a coarseness of the yarn passing through the detection head 34 is input as an electric signal into a clearing unit 33, and if it exceeds an allowable range in consideration of a reference value, judgement is made that the yarn defect has been passed. Immediately, a cut command signal 38 is output to a cutter drive device 37 from a clearing unit 36 so that the cutter is actuated to forcibly cut a yarn. With the cutting of yarn, a yarn travel signal issued from the head 34 is turned off to sense a yarn cut, and a stop command of a traverse drum drive motor 39 is provided from a unit controller 41 to stop rotation of the drum 35. Subsequently, a piecing command signal 42 is output from the unit controller 41 to a piecing device 40 whereby the latter 40 is driven so that a yarn end on the package side and a yarn end on the bobbin side are joined by well known means.

In FIG. 6, a pulse generator indicated at 43 for detecting rotation of the drum 35 is composed of a magnet piece 44 secured to a part of the drum end and a proximity sensor 45. A pulse signal 46 corresponding to the rotational frequency of the drum 35 is input from the unit controller 41 to a sizing device at the end of the machine bed to measure and calculate the length of yarn to be wound.

Figure 5:
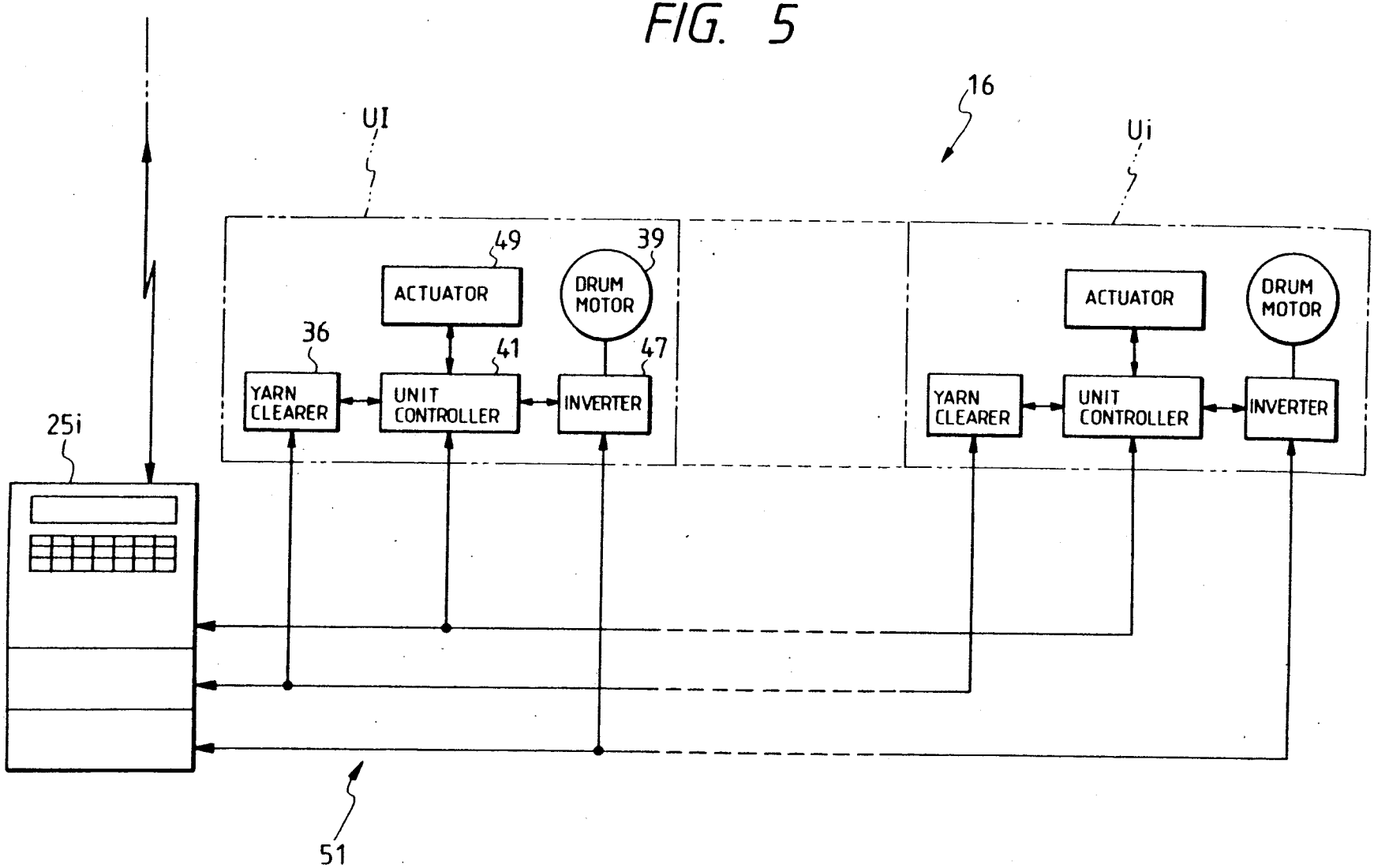
FIG. 5 is a schematic structural view of an automatic winder that may be applied to the present invention.
Figure 6:
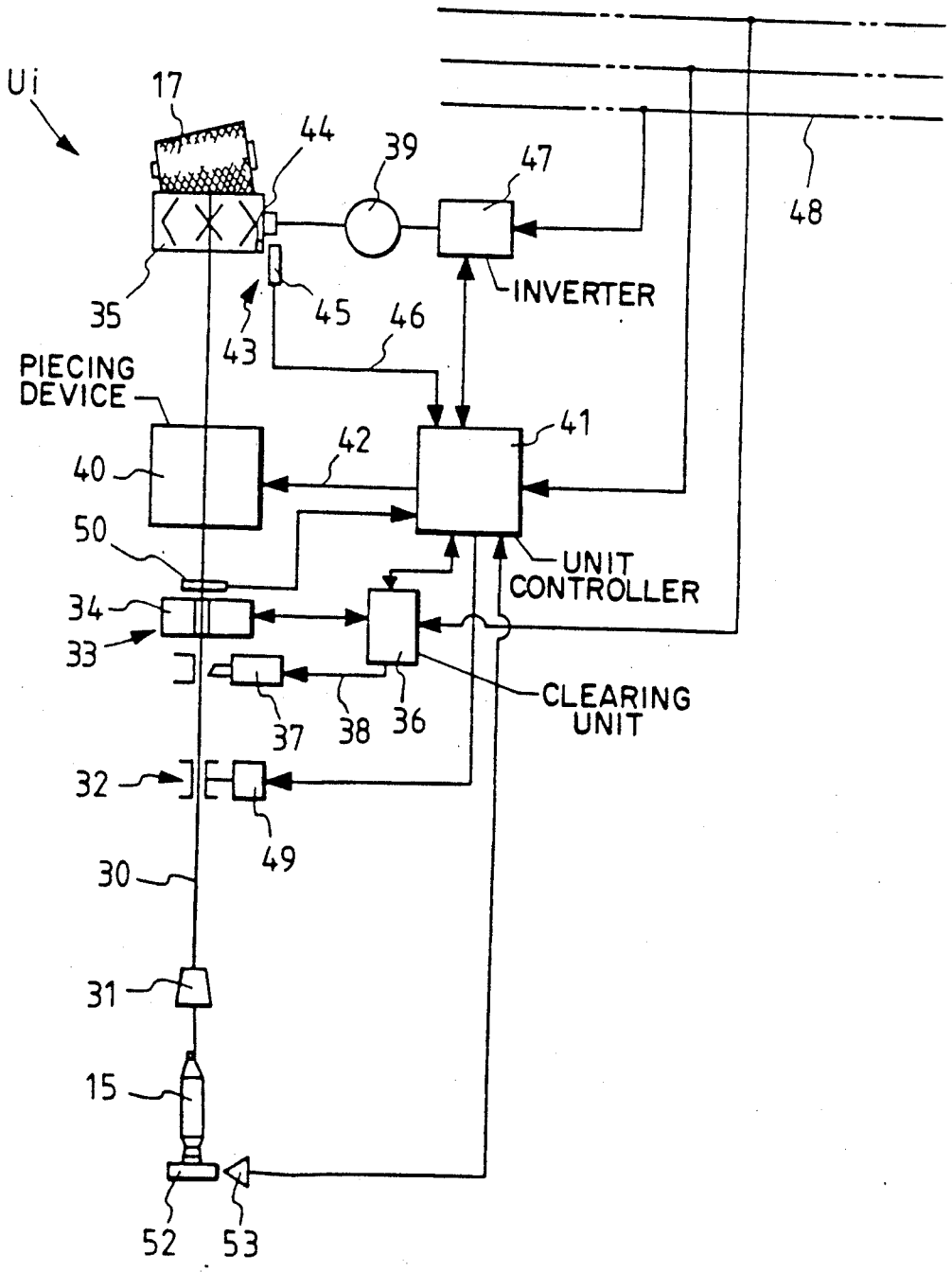
FIG. 6 is a schematic structural view showing one example of a winding unit.

The winding unit is at each unit provided with a drum drive motor 39 and an inverter 47 for controlling the rotational speed of the motor 39 so that the rotational speed suitable for the kind of yarns and count is controlled a signal buss 48 from a machine controller (25*i* in FIG. 5). In addition, a tension device 32 is provided to apply a tension to the travelling yarn. In this tension device 32, a yarn is made to pass between two tension disks, and a pressing force between the tension disks can be controlled by an actuator 49 such as a rotary solenoid and a spring. The aforesaid pressing force can be also controlled by the controller so as to assume the optimum value according to the kind of yarn, count, yarn speed or the like. Further, a tension sensor 50 for detecting tension of an actual travelling yarn is arranged in the midst of a yarn travelling path, and the tension device is controlled on the basis of a detection signal from the sensor 50 whereby a variation of tension of yarn can be suppressed.

A plurality of the winding unit Ui are disposed to constitute one unit of winder. The winding units Ul to Ui are connected by a machine bed controller 25*i* with a computer encased therein and a buss line 51. The setting of the operating conditions such as the yarn speed, tension and the like are provided from the controller 25*i* to each of the units, whereas from each of the units, information indicative of operating conditions such as the frequency of yarn cuts, the pulse signal for rotation of the drum for the sizing device, the yarn uneven signal by the yarn clearer, the yarn cut signal, the tension variation signal and the like, and the yarn quality information are input into the controller 25*i* for memory and calculation processing and the operating state is monitored.

On the other hand, a spinning machine 14 for supplying bobbins to the winder is arranged as shown in FIG. 2, and in the spinning machine 14, likewise the winder, one unit of a machine bed is constituted by a number of spinning units Sl to Si so that doffed spinning bobbins are supplied toward the winder in a fixed order. The spinning winder capable of being applied is as disclosed in Japanese Patent Application Laid-Open No. 163268/1984, for example.

FIG. 4 shows a specific example of pursuing the cause of defects in the above-described system. A yarn unevenness in an allowable range with yarn clearer operating conditions according to the kind of yarns, count and yarn speed commanded in advance from a data bank encasing therein a controller (25*i* in FIG. 5) (Step ) is set to the yarn clearer of each of the winding units (Step ). During the operation of the unit, the yarn unevenness, that is, the variation of coarseness and the length of defect and detected by the sensing head (Step ), and when a signal in excess of a set cut level (Step ) is detected, the yarn is cut by means of a cutter 37 shown in FIG. 6. A yarn-cut signal which is the compulsory cause and a yarn-cut signal resulting from the tension cut are input into the controller 25*i* and the yarn-cut frequency is counted and stored (Step ). For example, in the case where the yarn-cut frequency per spinning bobbin, that is, per unit length exceeds the allowable frequency calculated experimentally or statistically, or in the case where no yarn-cut condition continues for an abnormally long period of time, judgement is made that the unit is abnormal (Step ). The controller 25*i* discriminates if said malfunction occurs merely in the specific spindle or occurs over a plurality of spindles (Step and Step ). In the case of the specific spindle, the malfunction check of the spindle (Step ) or the check of the operation setting conditions such as tension, and the like are carried out (Step ). Particularly, in the case where the machine has no malfunction (Step ), judgement is made that the bobbin supplied to the spindle is defective (Step ). In this case, the spinning machine bed in the previous step which has produced said defective bobbin and the specific spinning spindle are grasped (Step , Step ).

On the other hand, when malfunction is detected over a plurality of spindles of the winder, the setting conditions of the group (span) of said plurality of spindles and the other group (span) are compared (Step ). In the case where the yarn speed, tension and the like are different to bring forth a malfunction (Step ), the setting conditions are adjusted (Step ). In the case where the malfunction does not result from the machine in comparison with the other group, judgement is made that bobbin is defective (Step ), and the spinning machine bed which has produced these bobbins is specified (Step ). The spinning machine bed can be specified, for example, by writing the spinning machine bed number and spinning spindle number on a bobbin or a bobbin carrier (for example, a tray 52 shown in FIG. 6) when a bobbin doffed by the spinning machine is moved out of the machine, reading said spinning machine bed number and spindle number of the bobbin supplied to the winding unit by a sensor 53 in the winder, and specifying the spinning machine bed on the basis of a malfunction signal generated during rewinding.

In the specified spinning machine, an abnormal spindle is grasped on the basis of data sent from the winder. When the spindles which have produced the defective bobbin are only specific spinning spindles such as 1 and 2, judgement is made that the subject spindle has some kind of mechanical malfunction or the setting condition is erroneous and checking is effected (Step ). In the case where the spindles which have produced the defective bobbin are present on the average over the entire machine bed (Step ), the operating condition of the entire machine bed is checked (Step ). When judgement is made that the operating condition is not erroneous, judgement is made that the sliver produced in the previous step involves the cause of defect (Step ) to transmit a check command signal to the cell computer 4 in the roving step which is the previous step through the network (W in FIG. 2). Also in the roving step, the roving machine bed which has produced the defective sliver or a spindle is specified in a manner similar to that as described above (Step ).

Figure 7:
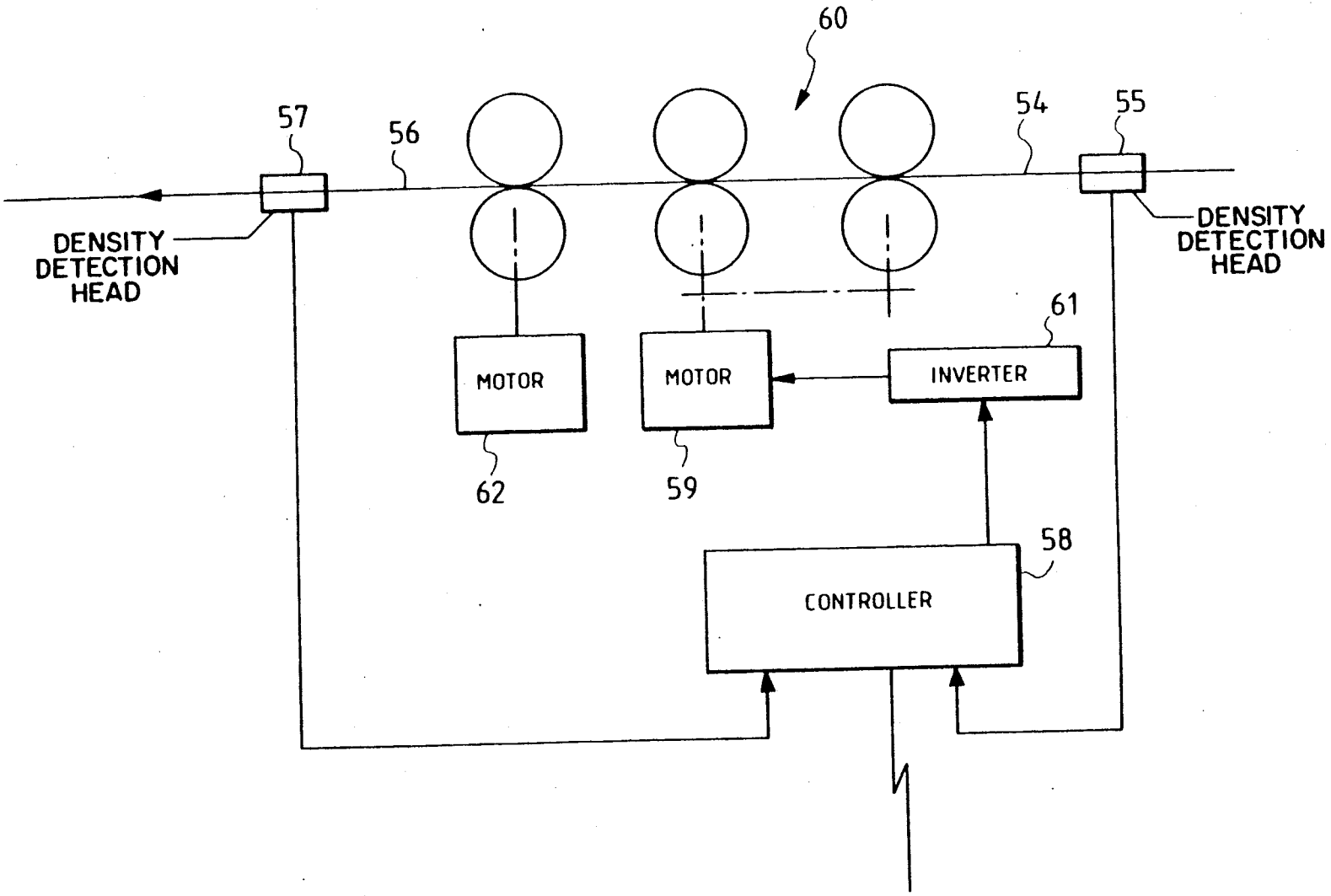
FIG. 7 is a structural view of draft portion parts showing one example wherein malfunction detection means is provided in a roving step.

While in the above-described embodiment, the case where the malfunction detection means is arranged on the winder has been described, it is to be noted that malfunction detection means may be provided on the spinning machine or roving machine as shown in FIG. 7.

That is, in a draft portion 60 of the roving machine, a density detection head 55 of a sliver 54 or a density detection head 57 of a sliver 56 is provided at inlet or outlet of the sliver of the draft roller. Density variation signals obtained from the detection heads 55 and 57 are input into a controller 58, and it is compared with a preset data and if it is different from a set value, a correction command is provided for an inverter 61 of a draft roller driving motor 59 to control rotational frequency of the motor 59 or motor 62 to check a density variation signal obtained from the detection head 57. In such a case, data (density variation signal) of an uneven signal of a sliver obtained from the detection head 55 is transmitted from the controller 58 to a computer which control the entire machine bed. In the case where the uneven signal of the sliver is greatly varied, a check signal is provided for the previous step which has produced a sliver disposed on the machine bed, that is, the drawing step.

In this manner, the cause of defect is pursued successively tracing back to the previous steps. This pursuit of cause is made possible by the transfer of information between the respective steps through the communication network W in FIG. 1.

In FIG. 2, information such as the operating conditions, occurrence state of defects and production status in the machine beds or spindles in the respective steps are transmitted to and stored in the mill computer 8 or the central computer 7 in the main office through the networks W, W1, W2 and W3 so that working status of the machine beds in the mills can be grasped in a concentrated manner.

As described above, in an embodiment of the present invention, production steps of yarns are formed into on-line by the communication networks, and means for detecting a malfunction of a yarn is provided on at least either of the steps whereby the cause of defect of yarn can be pursued not only within the steps but by successively tracing back to the previous steps, and in addition, the real time processing can be made during the operation.

What is claimed is:

1. In a spinning mill having a plurality of sequential yarn processing steps, the improvement comprising a quality control system comprising:

a communication network interconnecting the yarn processing steps;

abnormality detection means, associated with each yarn processing step, for detecting an abnormality of yarn; and means for tracing back the cause of an abnormality from the yarn processing step associated with an abnormality detection means which detects an abnormality to the previous processing step through the communication network.

2. The quality control system as claimed in claim 1, wherein said yarn processing steps are grouped into three sections, the three sections comprising a first section for a fore-spinning step including a mixing and blowing step and a roving step, a second section for a spinning step for producing yarns by spinning winder and a third section for a weaving and knitting step for producing woven stuff or knitwork by use of the produced yarns, the quality control system further comprising a central processing unit and a cell computer associated with each section for controlling the steps of the associated section, the communication network interconnecting the cell computer and the central process unit.

3. The quality control system as claimed in claim 2, wherein each cell computer comprises means for controlling the operation of the machineries in the associated section and for transferring information to and from the cell computers associated with the other sections of the three sections for maintaining a normal operation or controlling the production speed of the sections when a trouble occurs in any of the sections to lower the production speed.

4. A quality control system in a spinning mill having a series of yarn processing steps, the system comprising:

a communication network connecting respective processing steps of the series of processing steps for communication therebetween;

abnormality detection means, associated with each of the steps, for detecting an abnormality of yarn; and means for communication through the network and between the respective processing steps for tracing the cause of a yarn abnormality back to a processing step provided previous to the processing step associated with the abnormality detection means.

5. The quality control system as claimed in claim 4, wherein:

the yarn processing steps are grouped into three sections, the three sections comprising a first section having means for performing a fore-spinning step including a mixing and blowing step and a roving step, a second section having means for performing a spinning step for producing yarns by a spinning winder and a third section having means for performing a weaving and knitting step for producing woven stuff or knitwork by using the yarns produced with the second section;

the first section is associated with a first cell computer for controlling the fore-spinning step;

the second section is associated with a second cell computer for controlling the spinning step;

the third section is associated with a third cell computer for controlling the weaving and knitting step; and the first, second and third cell computers being connected by the communication network to a central processing unit.

6. The quality control system as claimed in claim 5, wherein each cell computer comprises:

means for transferring information to and from the cell computers associated with the other sections of the three sections; and means for altering the production speed of the section associated therewith when a situation occurs in any of the sections requiring an alteration of the production speed.

7. A quality control method in a spinning mill having a plurality of sequential yarn processing steps including first and second yarn processing steps for processing a yarn material in the first yarn processing step and, thereafter, in the second yarn processing step, a communication network connecting the plurality of processing steps for communication therebetween, abnormality detection means associated with the second processing step for detecting an abnormality of yarn processed by the second processing step, means for checking the operation of the second processing step; and means for communicating between the first and second processing steps through the communication network, the method comprising the steps of:

processing yarn in the plurality of processing steps;

detecting an abnormality of yarn processed by the second processing step;

checking the operation of the second processing step upon a detection of an abnormality of yarn processed by the second processing step; and communicating information for tracing the cause of the yarn abnormality through the communication network, from the second processing step to the first processing step upon the step of checking the operation of the second processing step revealing that the second processing step operates substantially correctly.

8. A method as claimed in claim 7, wherein the spinning mill further has means for checking the operation of the first processing step, the method further comprising the step of checking the operation of the first processing step upon communication of information for tracing the cause of the yarn abnormality from the second processing step to the first processing step.

* * * * *